US008205934B2

(12) United States Patent
Homans

(10) Patent No.: US 8,205,934 B2
(45) Date of Patent: Jun. 26, 2012

(54) PORTABLE CHAIR

(75) Inventor: Samuel B. Homans, Oakland, CA (US)

(73) Assignee: Alite Designs, Inc., San Francisco, CA (US)

( * ) Notice: Subject to any disclaimer, the term of this patent is extended or adjusted under 35 U.S.C. 154(b) by 308 days.

(21) Appl. No.: 12/050,117

(22) Filed: Mar. 17, 2008

(65) Prior Publication Data

US 2009/0230736 A1 Sep. 17, 2009

(51) Int. Cl.
*A47C 4/00* (2006.01)

(52) U.S. Cl. ... 297/16.2; 297/16.1; 297/45; 297/440.11; 297/17.4

(58) Field of Classification Search ..... 297/16.2, 297/45, 48, 56, 451.3, 440.11, 440.24, 16.1, 297/17, 4, 452.13
See application file for complete search history.

(56) References Cited

U.S. PATENT DOCUMENTS

| | | | | | |
|---|---|---|---|---|---|
| 180,074 | A | * | 7/1876 | Skinner | 248/155.2 |
| 291,062 | A | * | 1/1884 | Latour | 403/170 |
| 2,099,345 | A | * | 11/1937 | Olszanowski | 297/4 |
| 2,257,831 | A | * | 10/1941 | Wood | 280/812 |
| 2,567,595 | A | * | 9/1951 | Bryant | 108/116 |
| 3,266,839 | A | * | 8/1966 | Combs | 297/57 |
| 3,312,437 | A | * | 4/1967 | Barth | 248/158 |
| 3,432,162 | A | * | 3/1969 | Flemming | 482/77 |
| 3,538,512 | A | * | 11/1970 | Dolan | 2/227 |
| 3,884,524 | A | * | 5/1975 | Eberle | 297/160 |
| 4,095,842 | A | * | 6/1978 | Tretick | 297/4 |
| 4,101,163 | A | * | 7/1978 | Morin | 297/16.1 |
| 4,124,188 | A | * | 11/1978 | Machen | 248/188.6 |
| 4,148,520 | A | | 4/1979 | Miller | |
| 4,258,951 | A | | 3/1981 | Groom | |
| 4,494,796 | A | * | 1/1985 | Liebhold | 297/440.24 |
| 4,605,261 | A | * | 8/1986 | Lee | 297/16.2 |
| 4,671,566 | A | * | 6/1987 | Knapp et al. | 297/16.2 |
| 4,673,211 | A | | 6/1987 | Hoffman | |
| 4,685,725 | A | * | 8/1987 | Helfrich | 297/45 |
| 4,807,930 | A | | 2/1989 | Helfrich | |
| 4,810,029 | A | * | 3/1989 | Kaladis et al. | 297/16.2 |
| 4,836,601 | A | | 6/1989 | Cone | |
| 4,892,352 | A | * | 1/1990 | Haywood | 297/195.11 |
| 4,930,839 | A | * | 6/1990 | Saito et al. | 297/338 |
| 5,054,849 | A | * | 10/1991 | Hoff | 297/45 |
| 5,499,857 | A | | 3/1996 | Lynch, Jr. | |
| 5,709,428 | A | | 1/1998 | Hugghins | |
| 5,718,473 | A | | 2/1998 | Lynch, Jr. | |
| 5,921,621 | A | | 7/1999 | Cook et al. | |
| 5,927,797 | A | * | 7/1999 | Ferguson | 297/4 |
| 5,979,976 | A | * | 11/1999 | Ferencik | 297/16.1 |
| 5,988,750 | A | | 11/1999 | Rubottom | |
| 6,062,638 | A | * | 5/2000 | Ferguson | 297/4 |
| 6,062,648 | A | * | 5/2000 | Adler | 297/440.24 |
| 6,485,095 | B2 | * | 11/2002 | Haubeil | 297/16.1 |
| 6,634,704 | B1 | | 10/2003 | Bergquist | |
| 6,698,827 | B2 | | 3/2004 | Le Gette et al. | |
| 6,820,927 | B2 | * | 11/2004 | Isom et al. | 297/16.2 |
| 6,834,916 | B2 | * | 12/2004 | Volkman et al. | 297/270.1 |

(Continued)

*Primary Examiner* — Laurie Cranmer
(74) *Attorney, Agent, or Firm* — Jeffrey Schox

(57) ABSTRACT

The portable chair frame that supports a sling of the preferred embodiments includes a brace, a first pair of collapsible bars, a second pair of collapsible bars, and two joints that each provide a point of contact with a ground surface. Each collapsible bar has a first end coupled to the brace and a second end that provides a sling interface for the sling. The joints are included in each of the collapsible bars of the first pair of collapsible bars.

38 Claims, 8 Drawing Sheets

U.S. PATENT DOCUMENTS

| | | | | |
|---|---|---|---|---|
| 6,871,905 | B2 | 3/2005 | Grace | |
| 6,893,097 | B1 * | 5/2005 | Ebensperger et al. | 297/451.4 |
| 6,926,355 | B2 | 8/2005 | Le Gette et al. | |
| 7,044,267 | B2 * | 5/2006 | Sigler | 182/15 |
| 7,137,351 | B2 | 11/2006 | Picou | |
| 7,198,324 | B2 | 4/2007 | Le Gette et al. | |
| 7,240,961 | B2 | 7/2007 | Grace | |
| 2003/0222484 | A1 | 12/2003 | Gette et al. | |
| 2004/0232740 | A1 | 11/2004 | Enge | |
| 2005/0285436 | A1 | 12/2005 | Le Gette et al. | |
| 2006/0061146 | A1 | 3/2006 | Grace | |
| 2006/0071512 | A1 | 4/2006 | Saakyan | |

* cited by examiner

PORTABLE CHAIR

TECHNICAL FIELD

This invention relates generally to the chair field, and more specifically to a new and useful portable chair for use on uneven terrain.

BACKGROUND

Conventional portable chairs are not truly portable for outdoor use and cannot accommodate sitting on a hillside or uneven terrain. An example of one such portable chair is a "stadium seat" which consists of two flat pads with a hinge in the middle, rigid posts along their outer lateral edges and adjustable straps that run on each side of the pads from the top corner to the bottom corner. In a stadium seat, when a user leans back, the sides of the pads and posts are pulled in towards the body along with the straps, and generally, the heavier the user is, the more uncomfortable the stadium seat is. Further, the user cannot use this chair to sit comfortably on a hillside or on uneven terrain. Thus, there is a need in the chair field to create a new, useful, portable, and comfortable chair for use on uneven terrain. This invention provides such a new and useful portable chair.

DESCRIPTION OF THE PREFERRED EMBODIMENTS

The following description of the preferred embodiments of the invention is not intended to limit the invention to these preferred embodiments, but rather to enable any person skilled in the art to make and use this invention.

Figure 1:
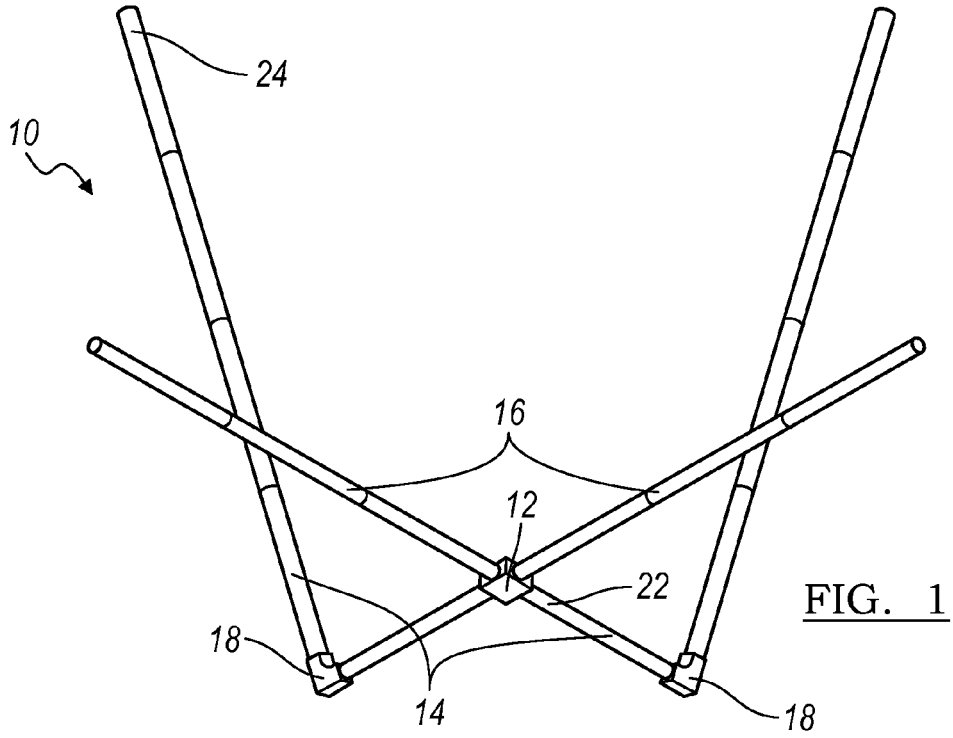
FIG. 1 is a drawings of the portable chair frame of a first preferred embodiment of the invention.
Figure 2:
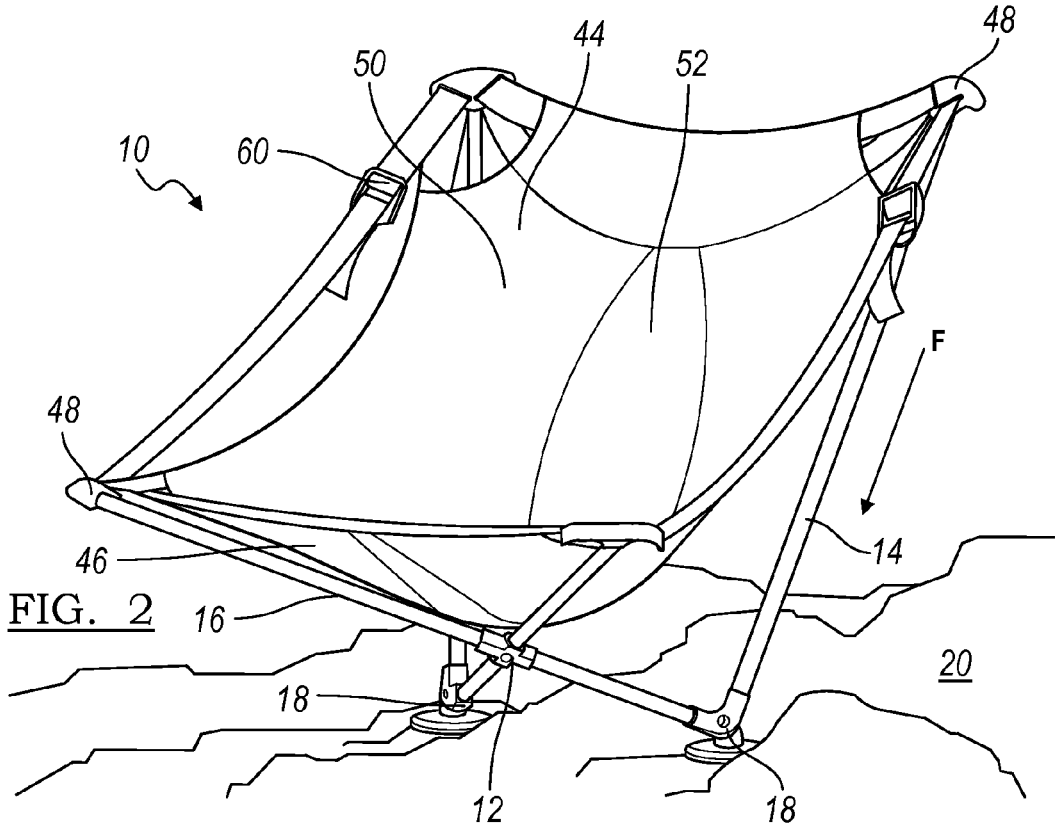
FIG. 2 is a drawings of the portable chair frame supporting a sling of a first preferred embodiment of the invention.

As shown in FIGS. 1 and 2, the portable chair frame 10 that supports a sling of the preferred embodiments includes a first pair of collapsible bars 14, a second pair of collapsible bars 16, and two joints 18 that each provide a point of contact with a ground surface 20. Each collapsible bar has a first end 22 coupled to the other first ends 22 and a second end 24 that provides a sling interface for the sling. The joints 18 are included in each of the collapsible bars of the first pair of collapsible bars 14. The portable chair frame 10 further includes a brace coupled to the first ends 22 of the collapsible bars. The portable chair frame 10 is preferably designed to be a portable chair frame that supports a sling and, more specifically, a portable chair frame that supports a sling designed for use on uneven terrain. In use, a user preferably sits in the sling supported by the portable chair frame 10. The portable chair frame 10 provides two points of contact with a ground surface 20, and the user provides a third point of contact with the ground surface 20 with their feet or legs. The joints 18 preferably prevent rotation of the chair about a single axis (i.e. preventing the chair from rotating from side to side, while allowing the chair to rock back and forth), while the user uses their legs and/or feet to stabilize the chair about a second axis (i.e. controlled rocking back and forth or preventing it all together). The portable chair frame 10 that supports a sling, however, may be alternatively used in any suitable environment and for any suitable reason.

1. The Portable Chair Frame

The brace 12 of the preferred embodiments functions to couple the first pair of collapsible bars 14 to the second pair of collapsible bars 16 and to hold the joints 18 a first distance from one another and to hold the second ends 24, which provide the sling interface, a second distance from one another. The first distance of the joints 18 is preferably less than the second distance of the second ends 24 such that the first pair of collapsible bars that each preferably run from two second ends 24 to the two joints 18 (the points of contact with a ground surface) are substantially parallel or inline with a generated force vector F, as shown in FIG. 2. The force vector is generated when a user sits in the sling, and their weight, supported by the sling, is transferred to the frame. The sling "pulls" on the frame, generating a force vector F in the direction shown. Due to the fact that the first collapsible bars are substantially parallel or inline with the generated force vector F, they are optimally positioned to support the force and are less likely to buckle, or fail in any other fashion.

Figure 5:
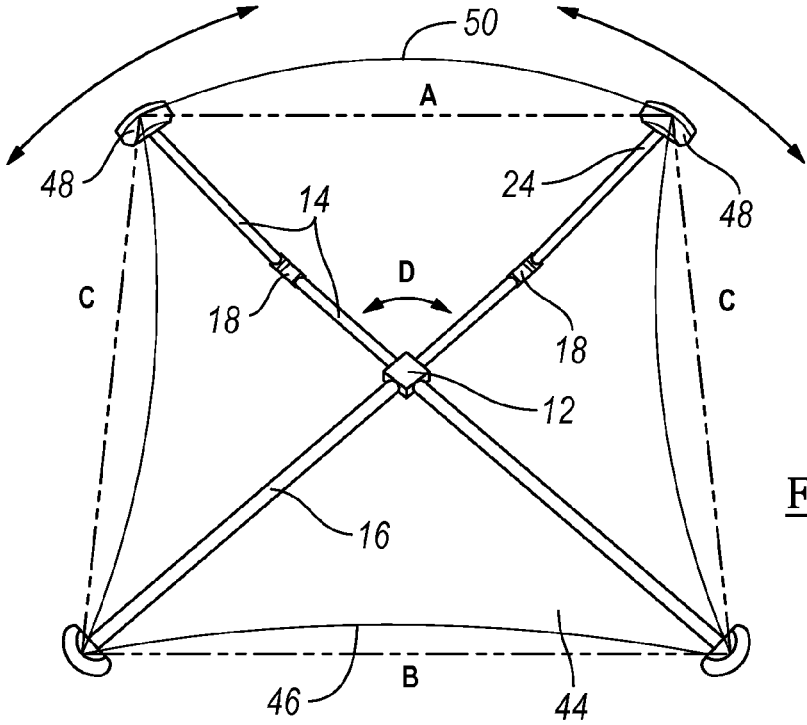
FIG. 5 is a drawing of the portable chair frame of a first preferred embodiment of the invention.

Additionally as shown in FIG. 5 the brace 12 holds the first ends of the first pair of bars 14 at a positive angle D less than 180 degrees (preferably substantially go degrees) which constrains the joints to rotate around the axes at angle D to one another. Therefore, the joints themselves are rigid and the sling interfaces 48 at the second ends 24 of the first bars 14 rotate in planes at angle D to one another. The sling interfaces 48 are also constrained in their movement by the sling itself. The upper portion 50 of the sling links together the sling interfaces at the second ends 24 of the first pair of collapsible bars such that the distance A between them cannot increase. The second pair of bars 16 are fixed in space so that their second ends 24 are at a fixed distance B from one another. This distance B is preferably greater than distance A. For the distance A to decrease, the distances C along the lateral edges of the sling would have to increase. Therefore the sling is held open when unoccupied. By the same token when a user is seated in the sling, while the users weight exerts a force on the sling that tends to pull the upper sling interfaces together, the force is resisted by the lateral edge of the sling and especially by the adjustment element 60 which are both connected to the fixed second ends of the second bars.

Additionally, the brace couples the first pair of collapsible bars 14 to the second pair of collapsible bars 16 such that the lines of the bars cross at the brace. This preferably helps the frame push the second ends 24 that provide a sling interface away from one another rather than towards one another due to the weight of the user. The brace 12 is located close to the sling such that is minimizes the bending forces of the bars, and such that it is above the ground surface to allow the joints 18 to contact an uneven ground surface. The uneven ground surface is preferably able to cross through the line and/or break the plane created by the two points of contact of the joints 18, as shown in FIG. 2, such that the ground surface can be sand, rock, hillside, or any other suitable uneven terrain.

Figure 3A:
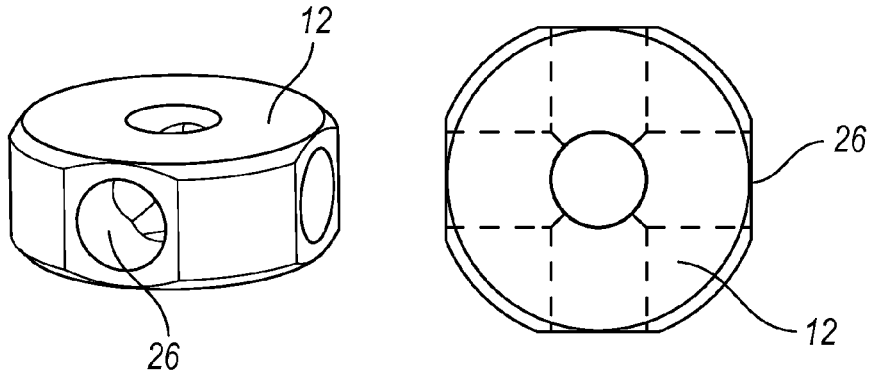
FIG. 3A is a drawing of a side view and a top view of the brace of a first preferred embodiment of the invention.
Figure 3B:
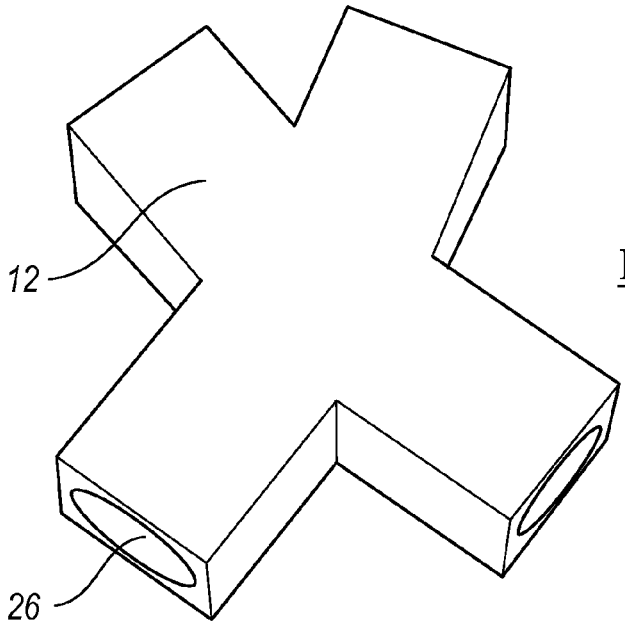
FIG. 3B is a drawing of a perspective view of the brace of a first preferred embodiment of the invention.
Figure 4:
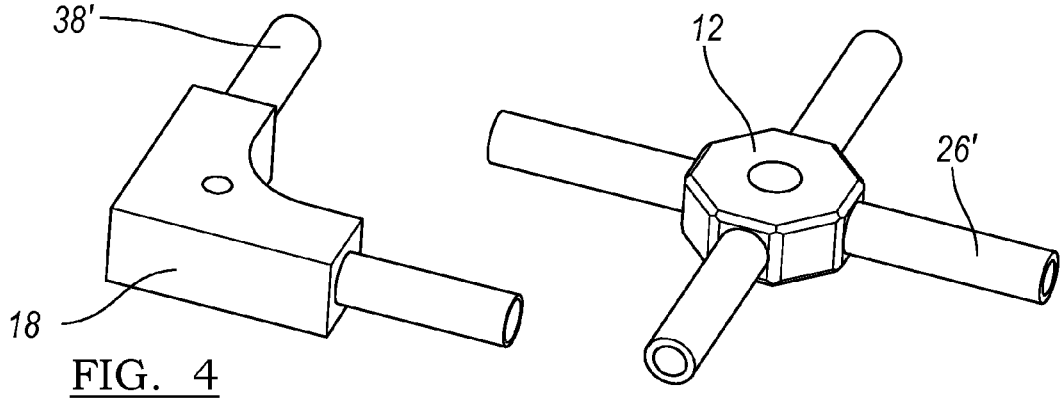
FIG. 4 is a drawings of the brace and the joint of a first preferred embodiment of the invention.

The brace 12 is preferably one of several variations. As shown in FIGS. 3A and 4, a first variation of the brace 12 of the preferred embodiment defines four receiving elements 26. The receiving elements each receive a portion of a collapsible bar such that the brace and the collapsible bars inserted into the receiving elements are preferably in substantially the same plane. The brace and the receiving elements preferably restrict movement of the collapsible bars in at least one direction. The collapsible bars may pivot or rotate with respect to the brace, such that they may fold up over or with the brace. Alternatively, the collapsible bars may be fixed by the brace. As shown in FIG. 3A, the receiving elements preferably position the collapsible bars inserted into the receiving elements at substantially right angles to one another, but may alternatively position the collapsible bars inserted into the receiving elements at any suitable angle to one another, including a combination of different angles, as shown in FIG. 3B. The brace 12 may have any suitable geometry to define the four receiving elements 26, such as a cross shape as shown in FIG. 3B. In a first version of the first variation, as shown in FIG. 3A, the brace 12 is cylindrical and defines a cavity that receives a portion of a collapsible bar. The cavity is preferably cylindrically shaped, but may alternatively have any suitable shape such that it receives a portion of a collapsible bar. In a second version of the first variation, as shown in FIG. 4, the brace 12 is cylindrical and defines a center hole to reduce the mass of the brace 12 and functions to receive a portion of a collapsible bar around the outer diameter of the cylindrical receiving element or inside the inner diameter of the cylindrical receiving element. The receiving elements are preferably connected such that a cord or a portion of a collapsible bar may run from one receiving element to another receiving element. Although the brace 12 and the receiving elements 26 are preferably one of these two versions of the first variation, the brace 12 and the receiving elements 26 may be any suitable element to couple the first pair of collapsible bars 14 to the second pair of collapsible bars 16 and to hold the joints 18 a first distance from one another.

Although the brace 12 is preferably one of these several variations, the brace may alternatively be any suitable mechanism to couple the first pair of collapsible bars 14 to the second pair of collapsible bars 16 and to hold the joints 18 a first distance from one another and hold the second ends 24, which provide the sling interface, a second distance from one another.

Figure 6:
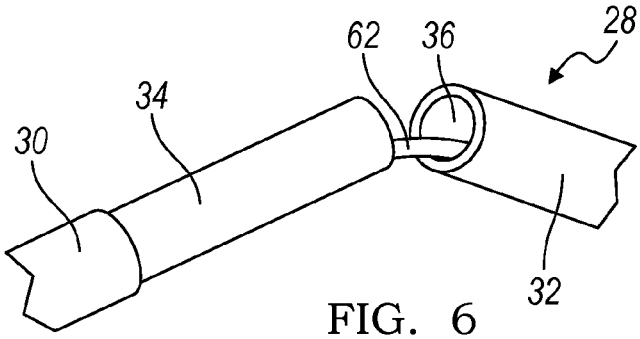
FIG. 6 is a drawings of the first bar section and the second bar section of the preferred embodiment of the invention.

The bars of the preferred embodiments function to support the sling and the weight of a user. The bars are preferably one of several variations. As shown in FIG. 2, the bars (the first pair of bars 14 and the second pair of bars 16) are preferably cylindrical rods, but may alternatively have any suitable geometry and may have varying geometries along the length of the rods. The bars are preferably straight or linear bars, but may alternatively be curved, bent, or have any other suitable geometry. The bars are preferably made of metal (such as 0.433" 7075 T9 aluminum poles with a 0.030" wall thickness), or plastic, but may be alternatively made from any suitable material. The bars 14 and 16 are preferably collapsible or foldable such that they include multiple sections that can be assembled to support the sling and the weight of the user and can be disassembled for easy transportation and storage. Each of the sections are preferably straight, but may alternatively be curved or angled. Each section may have the same radius of curvature or angle, but alternatively each section may have a different radius of curvature or angle. As shown in FIG. 6, the collapsible bar 28 includes a first bar section 30 and a second bar section 32 removably coupled to a first bar section 30. The first bar section 30 preferably has an end portion with an outer diameter dimension 34 and the second bar section 32 preferably has an end portion that defines a recess 36 that receives the outer diameter dimension 34 of the end portion of the first bar section 30. The outer diameter dimension 34 preferably has a diameter less than the outer diameter of the collapsible bar. For example, they may have 0.370" outer diameter while the collapsible bars have an outer diameter of 0.433". The end portion of the first bar section 30 may be a separate piece that is coupled to the first bar section 30. For example, the separate piece may have an outer diameter of 0.433" with a 0.040" wall thickness. Alternatively, the first bar section may couple to the second bar section in any other suitable fashion. The first bar section 30 is preferably substantially identical to the second bar section 32, but alternatively, the first bar section 30 and the second bar section 32 may have different geometries, dimensions, and/or cross sections. Each collapsible bar preferably includes any suitable number of bar sections. In a first variation, as shown in FIG. 2, the first pair of collapsible bars 14 each include five bar sections and the second pair of collapsible bars 16 each include three bar sections. The joint 18 of the first pair of collapsible bars 14 preferably couples one bar section to four bar sections at a substantially right angle. The joint 18 may alternatively couple any suitable combination of bar sections at any suitable angle to one another.

Figure 7:
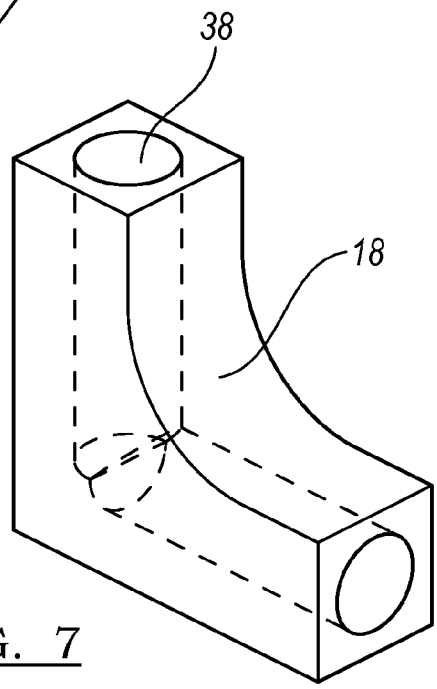
FIG. 7 is a drawing of a perspective view of the joint of a first preferred embodiment of the invention.

The joints 18 of the preferred embodiments function to provide a point of contact with a ground surface 20. The joints 18 are preferably one of several variations. In a first variation, as shown in FIG. 7, the joints 18 define two receiving elements 38. The receiving elements each receive a portion of a collapsible bar such that the joint and the bars inserted into the receiving elements are preferably in substantially the same plane. As shown in FIG. 7, the receiving elements preferably position the bars inserted into the receiving elements at substantially a right angle to one another, but may alternatively position the bars inserted into the receiving elements at any suitable angle to one another. The joint 18 may have any suitable geometry to define the two receiving elements 38. In a first variation, as shown in FIG. 7, the joint 18 is L-shaped and the receiving element is preferably a cavity that receives a portion of a collapsible bar. The L-shaped joint preferably has a pointed vertex, but may alternatively have a curved or flat vertex. The cavity is preferably cylindrically shaped, but may alternatively have any suitable shape such that it receives a portion of a collapsible bar. In a second variation, as shown in FIG. 4, the receiving element 38' is a cylindrical receiving element that functions to receive a portion of a collapsible bar around the outer diameter of the cylindrical receiving element or inside the inner diameter of the cylindrical receiving element. The receiving elements are preferably connected such that a cord or a portion of a collapsible bar may run from one receiving element to another receiving element. In an alternative variation, the joint 18 may be formed by bending a portion of a bar and the bar may be curved or bent to form the joint 18. The joint 18 is preferably made of metal (such as Aluminum) or plastic, but may be alternatively made from any suitable material. Although the joint 18 and the receiving elements 38 are preferably one of these variations, the joint 18 and the receiving elements 38 may be any suitable element to support the sling and the weight of a user.

Figure 8:
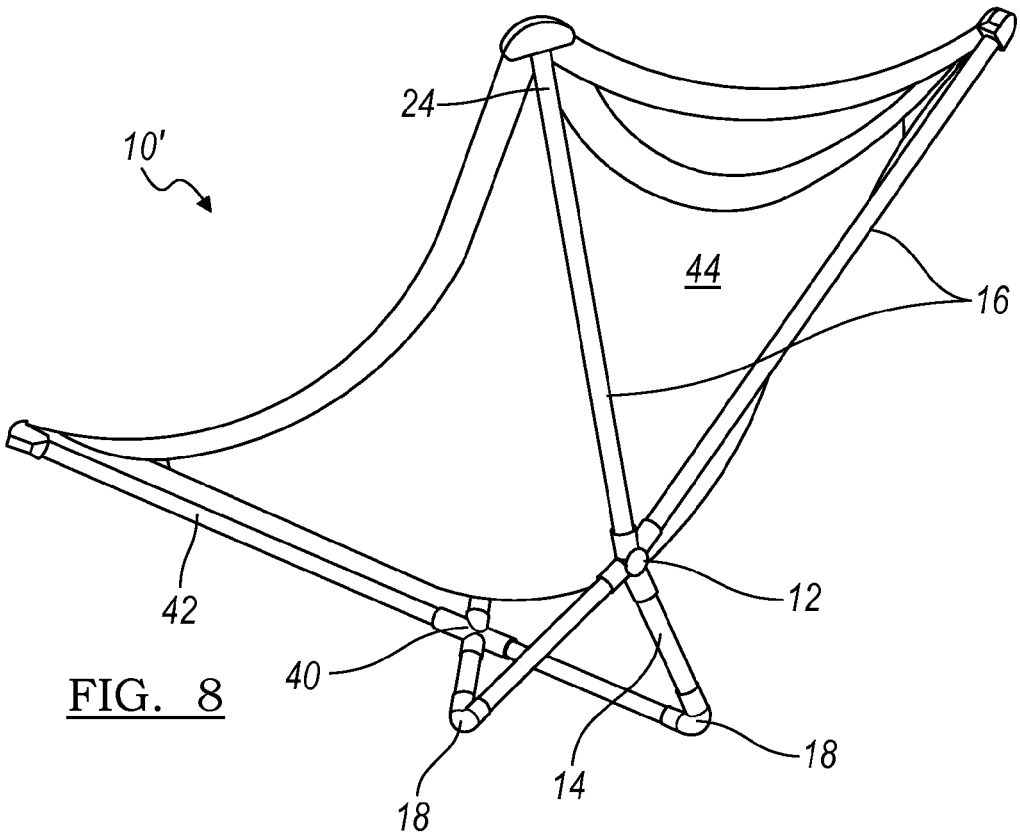
FIG. 8 is a drawings of the portable chair frame supporting a sling of an alternative preferred embodiment of the invention.

As shown in FIG. 8, the portable chair frame 10' of the second embodiment is nearly identical to the portable chair frame 10 of the first embodiment. The difference between the two embodiments, however, is that the portable chair frame 10' of the second embodiment further includes a second brace 40 and a third pair of collapsible bars 42. In this embodiment, the first pair of collapsible bars 14, including the joints 18, have a first end coupled to the first brace 12 and a second end coupled to the second brace 40 and the third pair of collapsible bars 42 each have a first end coupled to the second brace 40 and a second end 24 that provides a sling interface.

2. The Sling

Figure 9:
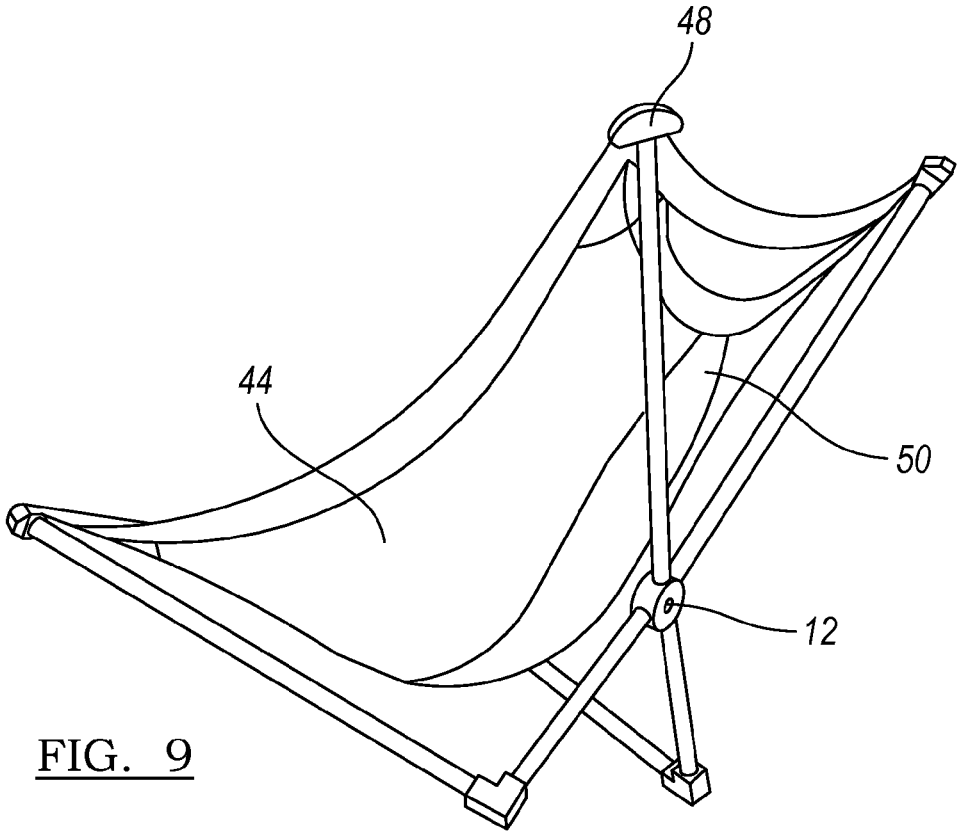
FIG. 9 is a drawings of the portable chair frame supporting a sling of a first preferred embodiment of the invention.

The portable chair frame 10 of the preferred embodiments also includes a sling 44, which is supported by the portable chair frame 10 and supports the weight of a user. As shown in FIG. 2, the sling 44 preferably includes a seat bottom portion 46 with two frame interface elements 48 and a seat back portion 50 with two frame interface elements 48. The four frame interface elements 48 are preferably coupled to the four sling interfaces of the collapsible bars. The four frame elements are preferably connected to the sling and removably coupled to the portable chair frame, but may alternatively be removably coupled to the sling and connected to the portable chair frame, removably coupled to both, or connected to both. In a first variation, as shown in FIG. 2, the frame interface elements 48 of the seat back portion 50 couple to the first pair of collapsible bars 14 and the frame interface elements 48 of the seat bottom portion 46 couple to a second pair of collapsible bars 16 such that the brace 12 is substantially adjacent or below the seat bottom portion 46 of the sling. In a second variation, as shown in FIG. 9, the frame interface elements 48 of the seat back portion 50 couple to the second pair of collapsible bars 16 and the frame interface elements 48 of the seat bottom portion 46 couple to the first pair of collapsible bars 14 such that the brace 12 is substantially adjacent or behind the seat back portion 50 of the sling. The sling is preferably made of a durable and/or waterproof material such as fabric, vinyl, or plastic, but may alternatively be made out of any suitable material.

The sling 44 of the preferred embodiments also includes a shaping element that functions to provide a "bucket" shape to the sling 44, which prevents the user from sliding forward out of the seat, especially when their feet are not firmly planted. The shaping element also preferably functions to allow the sides of the sling 44 to better contain the users' hips and to preferably provide better back support. The shaping element is preferably one of several variations. In a first variation, the shaping element is a gusset 52, as shown in FIG. 2, which runs from the seat bottom portion to the seat back portion. The gusset 52 is preferably diamond or lozenge shaped, but may alternatively have any other suitable geometry. In a second variation, the shaping element includes darts in the seat bottom portion of the sling. The darts may alternatively be located near the edges of the sling, but may alternatively be in any suitable portion of the sling to provide a "bucket" shape to the sling 44. In a third variation, the shaping element is a panel or portion of the sling made out of a stretchable fabric, such that the sling can expand to provide a "bucket" shape to the sling 44 when the user sits into the portable chair. The shaping element may alternatively be any other suitable shaping element that functions to provide a "bucket" shape to the sling 44 and allow the sides of the sling 44 to better contain the users' hips.

Figure 10:
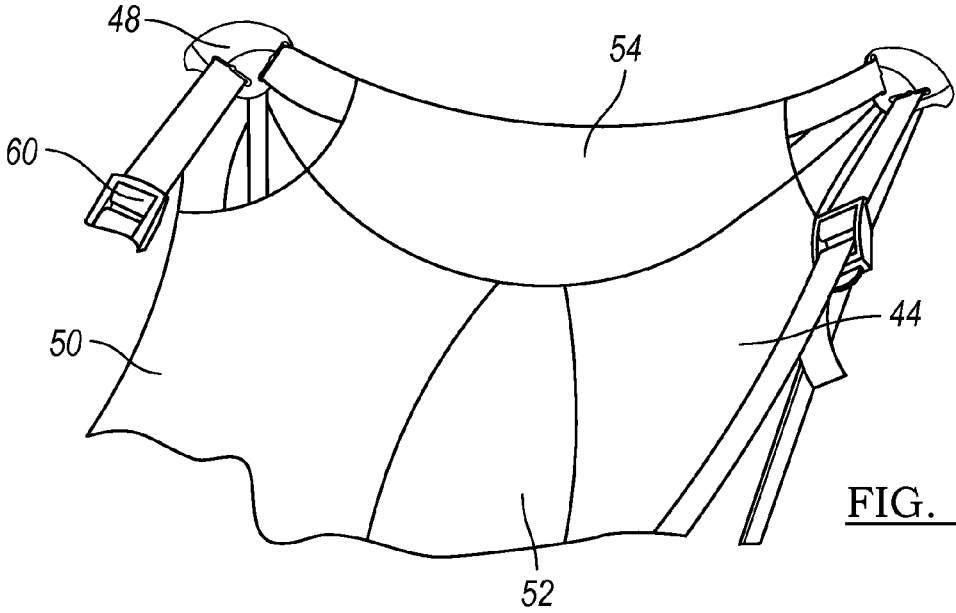
FIG. 10 is a drawings of the sling of the preferred embodiment of the invention.

The sling 44 of the preferred embodiments also includes a weight distribution element that functions to reduce the pressure of the sling 44 against the back of the user. The weight distribution element is preferably one of several variations. In a first variation, the weight distribution element is a panel 54, as shown in FIG. 10, in the seat back portion 50 of the sling that couples the two frame interface elements 48 to one another. The panel 54 is preferably semi-circular or crescent shaped such that when the weight of the user is applied to the sling, the top portion supports a first amount of weight and the bottom rounded portion supports a second amount of weight. The second amount of weight is preferably larger than the first amount due to the orientation of the bottom rounded portion with respect to the frame of the chair. The top portion is substantially perpendicular to the collapsible bar coupled to the seat back portion of the sling, and the bottom rounded portion, where it couples to the frame, is substantially parallel or inline with the collapsible bar such that the majority of the weight supported by the sling is supported by the bottom rounded portion rather than the top portion. The second amount of weight is preferably larger than the first amount of weight to reduce the tension on the upper sling edge 55 and reduce its pressure against the back of the user. The weight distribution element may alternatively be any other suitable variation to reduce the pressure of the upper sling edge 55 against the back of the user.

In one variation, as shown in FIG. 2, the sling 44 preferably includes four to six panels. The panel 54 at the top portion of the seat back portion 50 of the sling 44 has a semicircle shape and is positioned in the sling 44 such that the curved portion is lower than the straight portion. The three remaining panels radiate from curved portion of panel 54. One of those three panels is the gusset 52. The gusset 52 runs from the panel 54 to the bottom of the sling. Mirrored around the gusset 52 are two rectangular panels. The two outside panels are preferably substantially flat (i.e. not bucket shaped), but may alternatively include darts or any other suitable shaping element. The two outside panels may alternatively each be replaced by a two triangular panels, or may alternatively include any other suitable number of panels. The two triangular panels are substantially "30-60-90" triangles with the 90 degree angles adjacent to the gusset 52 at the bottom of the sling. On the outside of those two panels, are two more similarly shaped panels with the 90 degree angles located at the far outside, top corners of the sling. The two outside panels (each including two triangular panels) on each side of the gusset 52 form a rectangle on either side of the gusset 52.

Figure 11A:
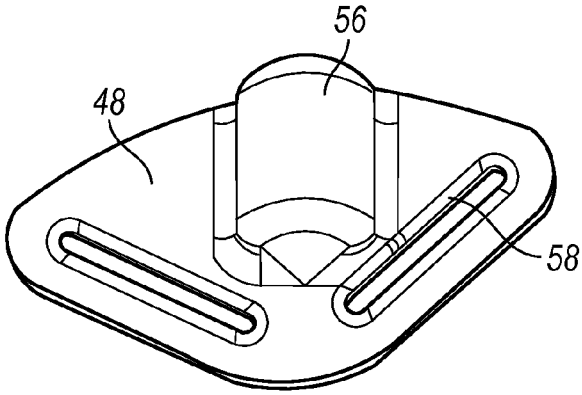
FIGS. 11A and 11B are drawings of a front view and a back view respectively of the frame interface element of a first preferred embodiment of the invention.
Figure 11B:
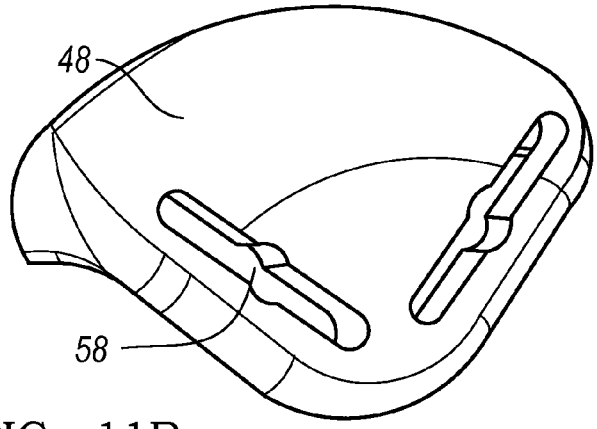

The frame interface elements 48 of the preferred embodiment function to couple the sling 44 to the portable chair frame 10. In a first variation, as shown in FIGS. 11A and 11B, the frame interface elements 48 each define a receiving element 56 that receives a portion of a collapsible bar and define a slot 58 that receives a portion of the sling 44. The frame interface element 48 preferably defines the receiving element 56 such that it holds the portion of the collapsible bar at a predetermined angle relative to the sling 44 and to the other collapsible bars. The frame interface element 48 preferably has a triangular geometry with two slots 58. The slots are preferably about one inch wide and located on the triangular face approximately 100 degrees from each other. A portion of the sling (i.e. a strap coupled to the sling 44) is preferably coupled to each of the slots of the frame interface element 48. In this variation, there is preferably a left and right handed version of the frame interface element 48 such that the left handed and the right handed version each hold the portion of the collapsible bar at a predetermined angle (depending on the left or right side of the sling) relative to the sling 44 and to the other collapsible bars. The frame interface element 48 of this variation preferably has a rounded edge along the top portion of the frame interface element 48 to prevent pressure or discomfort to the user. The frame interface elements are preferably made from metal, plastic, polycarbonate, or any other suitable material. The frame interface elements may be machined, injection molded, or manufactured in any other suitable fashion. In a second variation, frame interface elements 48 are grommets or washers coupled to or sewn into the sling 44 that slide over or otherwise couple to the second ends 24 of the collapsible bars. In a third variation, the frame interface elements 48 are pockets that are coupled to or sewn into the sling 44 that slide over or otherwise couple to the second ends 24 of the collapsible bars.

The sling 44 of the preferred embodiments also includes an adjustment element 60, as shown in FIGS. 2 and 10, that couples the seat bottom portion 46 to the seat back portion 50 and the length of the adjustment element 60 may be lengthened or shortened to increase or decrease the distance and the angle between the seat bottom portion 46 and the seat back portion 50. The sling 44 may further include straps coupled to the frame interface element 48 that run along the slide of the sling 44. The adjustment elements 60 are preferably coupled to these straps and function to lengthen and shorten the lengths of these straps. The adjustment element 60 is preferably a ladder-lock buckle, but may alternatively be any suitable adjustment element 60 that increases or decreases the distance and the angle between the seat bottom portion 46 and the seat back portion 50. The sling 44 may also include additional adjustment elements 60 at any suitable location on the sling 44 or the portable chair frame 10.

3. Additional Elements

The portable chair frame 10 of the preferred embodiments also includes a cord 62 that functions to couple the elements of the portable chair frame 10 together, as shown in FIG. 6. The first bar section 30 and the second bar section 32 are preferably hollow such that the cord 62 can couple the inside of the first bar section 30 to the inside of the second bar section 32. The cord preferably runs through the bar sections of a collapsible bar, through the brace, through the bar sections of a second collapsible bar, and through a joint 18 if one of the collapsible bars includes a joint 18. The portable chair frame 10 preferably includes two cords 62 that run through the structure from the corners (the sling interfaces) and function to pull the bar sections, brace, and joints together. The cord 62 is preferably an elastic cord, but may alternatively be any other suitable material such as fabric, plastic, metal, or a metal spring.

The portable chair frame 10 of the preferred embodiments may also include a pad. The pad is preferably coupled to the sling 44 at the seat back portion and/or the seat bottom portion, but may alternatively be coupled to any other suitable portion of the sling and/or the frame. In a first variation, the pads are cushions that are insertable in pockets defined by the sling. The user may insert and remove pads of varying thickness and/or density. In a second variation, the pads are inflatable. In this variation, the pads are preferably connected to the sling and include a valve through which they are inflated.

The portable chair frame 10 of the preferred embodiments may also include rockers. The rockers are preferably coupled to the joints 18, but may alternatively be coupled to any suitable portion of the portable chair frame 10. The rockers are preferably standard rockers as conventionally found on standard rocking chairs. The rockers are preferably rounded bands of material such as wood, metal, or plastic and couple to the ground surface such that the portable chair frame 10 may rock back and forth.

Figure 12A:
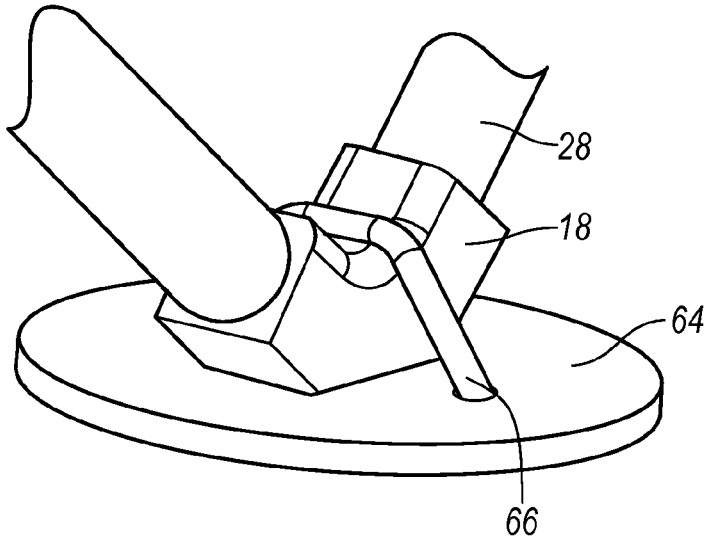
FIGS. 12A and 12B are drawings of a first variation and a second variation respectively of the base of a first preferred embodiment of the invention.
Figure 12B:
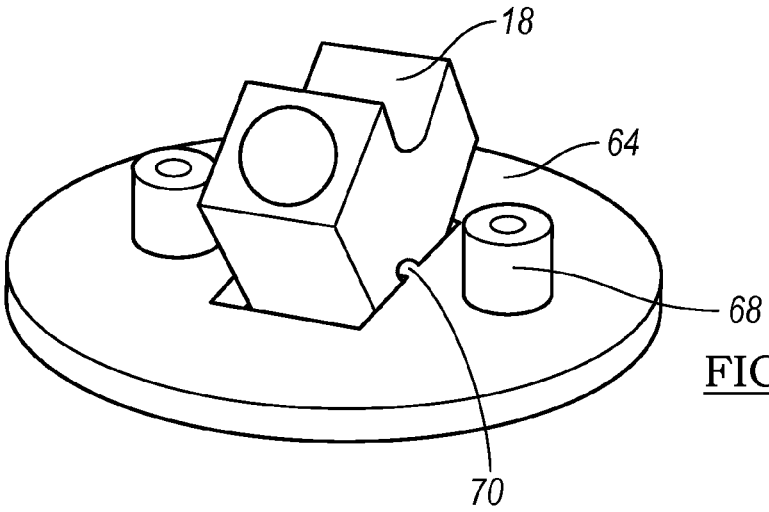
Figure 13:
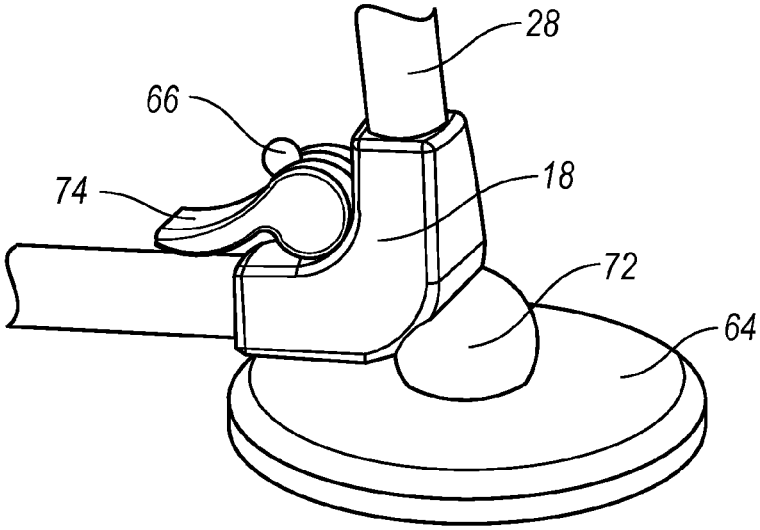
FIG. 13 is a drawings of a third variation of the base of the preferred embodiment of the invention.

The portable chair frame 10 of the preferred embodiments also includes a base 64, coupled to the joint 18, that cooperates with the joint 18 to provide a point of contact with the ground surface 20 with an increased surface area, as shown in FIGS. 12A, 12B, and 13. The joints 18 alone provide a point of contact with a ground surface and are ideal for gripping rocks, logs, and hard ground in general. On soft ground such as sand or grass, they may sink into the ground surface. The base 64 coupled to the joint 18, cooperates with the joint 18 to provide a point of contact with the ground surface 20 with an increased surface area such that the joint 18 and base 64 will not sink into the ground surface. The base 64 is preferably removable from the portable chair frame 10, but may alternatively be permanently attached to a portion of the portable chair frame 10. The base 64 is preferably circular and defines a square hole that couples to the joint 18, but may alternatively have any suitable geometry. The base is preferably made from metal, plastic, polycarbonate, or any other suitable material. The base may be machined, injection molded, or manufactured in any other suitable fashion. In a first variation, as shown in FIGS. 12A and 12B, the base 64 preferably includes a cable 66 that couples the base 64 to the joint 18. The cable 66 is preferably an elastic cable, but may alternatively be made out of rubber, plastic, fabric, or metal. In a second variation, as shown in FIG. 12B, the base 64 is preferably injection molded part and includes two hollow bosses 68, preferably located on the upper surface of the base 64 that contain the ends of the cable 66. In this variation, the base 64 may further include tab portions 70 that snap into the joint 18, as shown in FIG. 12B.

In a third variation, as shown in FIG. 13, the base includes a spherical indent on the top side and a center hole with a countersink on the bottom side to hold the cable 66 in place. The depth of the indent and the top surface of the base are preferably contoured in such a way that, on a level ground surface, joint 18 will only hit the base 64 when the portable chair frame is tilted past the point where the pair of collapsible legs that couple to the seat bottom portion of the sling are horizontal or in the opposite direction, past the point where the pair of collapsible legs that couple to the seat back portion of the sling are horizontal. The base 64 is also preferably contoured in such a way that if the bottom (or back) of the joint 18 does contact the base 64, it does so along its entire surface to avoid a lever action, which would overstress the joint. The base 64 in this variation is preferably injection molded, but may be manufactured in any other suitable fashion.

The base 64 also includes a coupler 72 that is preferably spherical in shape and dimensioned to couple with the spherical indent in the base 64. The coupler 72 preferably has an hourglass shape hollowed out of the inside of the sphere, such that it provides enough room for the cable 66 in any position that the base 64 and joint 18 can assume. The coupler 72 also keeps the cable at a substantially constant tension as it bends around the center of the coupler 72. The coupler 72 is preferably injection molded, but may be manufactured in any other suitable fashion. The cable 66 in this variation, is preferably made from an artificial fiber like nylon or a metal such as steel and may include an elastic element. At a first end of the cable 66, the cable includes a cone shaped plug that interfaces with the countersink geometry of the base 64. At the second end of the cable 66, the cable includes a ball dimensioned such that it can be inserted through a hole in the joint 18 and held by the cam buckle 74 on the opposite side. The cam 74 is preferably a cylinder with a finger-sized handle. The cam 74 is preferably slotted to accept the thickness of the cable 66 and preferably has pocket on the top side to accept the cable ball. The cam 74 is preferably a standard cam, but may alternatively be any suitable device. The joint 18 in this variation preferably becomes broader towards the back and has a spherical divot to accept the coupler 72. At the crook of the L-shaped joint 18 there is preferably a cylindrical surface for the cam 74 to ride in. It preferably has a hole from the center of the rear divot to the center of the crook of the L to accept the cable 66. The joint 18 in this variation is preferably CNC machined aluminum, but may alternatively be any other suitable material machined in any suitable fashion.

Figure 14:
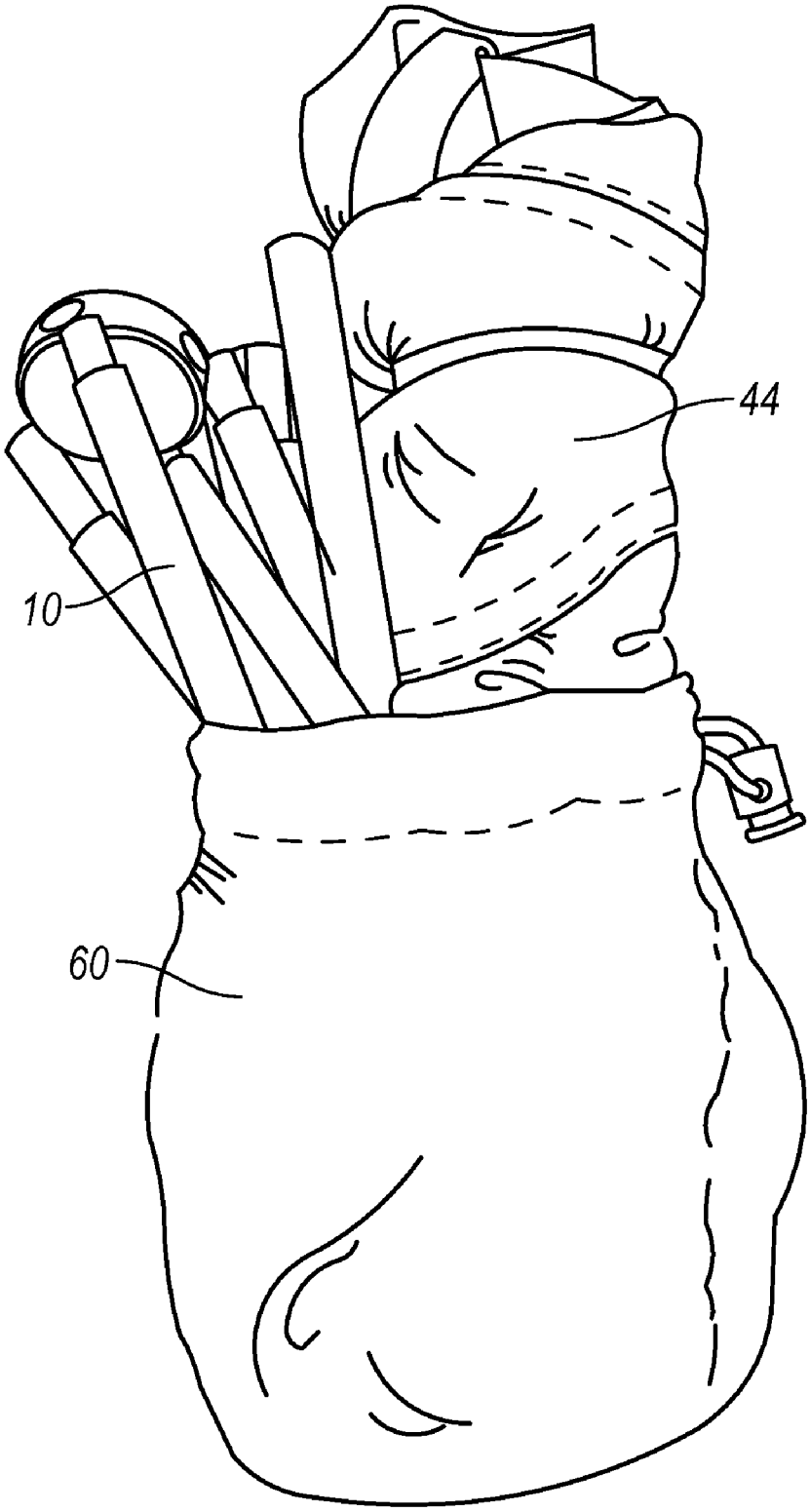
FIG. 14 is a drawings of the bag of a first preferred embodiment of the invention.
Figure 15:
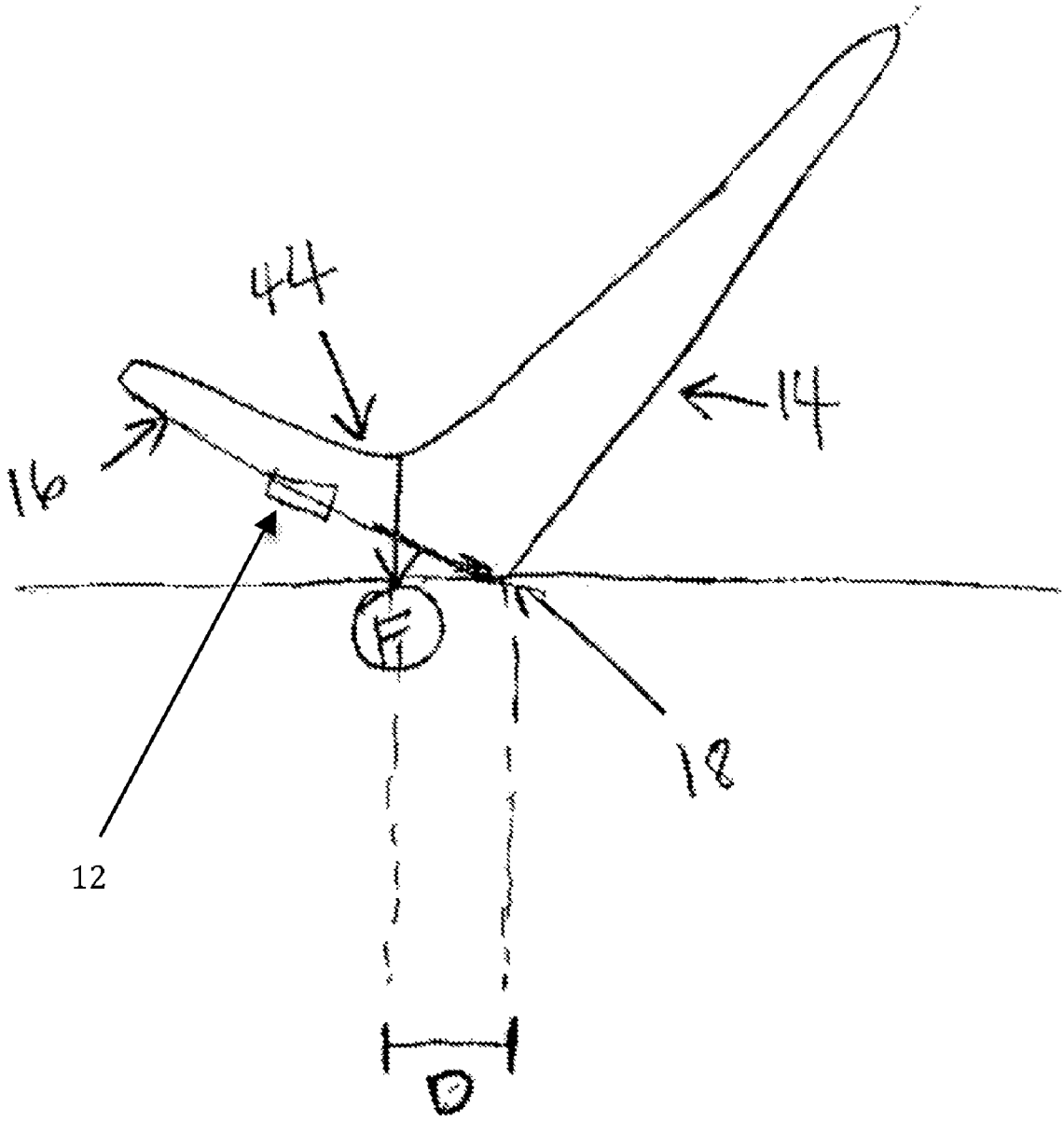
FIG. 15 is a schematic representation of the arrangement of the weight of the user in front of the joints of the first pair of bars.

The portable chair frame 10 of the preferred embodiments also includes a bag 68, as shown in FIG. 14, that functions to store the portable chair frame 10 and the sling 44, preferably when they are collapsed and folded. The bag 68 preferably has a length less than 10 inches (preferably less than or equal to 7 inches) and a diameter less than 5 inches (preferably less than or equal to 4 inches), but may alternatively have any suitable dimensions to store the portable chair frame 10 and/or the sling 44, preferably when they are collapsed and folded. The sling is preferably removed from the portable chair frame when they are collapsed and folded, but alternatively, the sling may remain coupled to the portable chair frame when they are collapsed and folded and/or the sling and frame may open in a fashion similar to the opening and closing mechanism of an umbrella, i.e. the portable chair frame and/or sling may pop open in a smooth motion similar to that of an umbrella opening and unfolding in one fluid motion.

As a person skilled in the art will recognize from the previous detailed description and from the figures and claims, modifications and changes can be made to the preferred embodiments of the invention without departing from the scope of this invention defined in the following claims.

I claim:

1. A portable chair frame, including a front and a back, that supports a sling that supports a user with the legs of the user toward the front of the chair frame and the back of the user toward the back of the chair frame, the portable chair frame comprising:

a first pair of bars that are each collapsible and include a plurality of bar sections that are removably coupled to each other, each of the first pair of bars having a first end and a second end;

a second pair of bars that are each collapsible and include a plurality of bar sections that are removably coupled to each other, each of the second pair of bars having a first end arranged substantially toward the back of the chair and a second end arranged substantially toward the front of the chair;

wherein the first end of each bar of the first pair of bars is coupled to a first end of a bar of the second pair of bars;

wherein each bar of the first pair of bars includes a joint that provides a point of contact with a ground surface and couples a first bar section to at least a second bar section at a substantially right angle to the first bar section; and wherein each of the second ends of each bar of the first and second pairs of bars provides a sling interface to cooperatively arrange the sling such that the weight of the user is substantially located in front of the joints of the first pair of bars.

2. The portable chair frame of claim 1, further comprising a brace that is coupled to the first end of each of the first pair of bars and the first end of each of the second pair of bars.

3. The portable chair frame of claim 2, wherein the brace defines four receiving elements, and wherein each receiving element is a cavity that receives a portion of the first end of a bar of one of the first and second pairs of bars.

4. The portable chair frame of claim 3, wherein the receiving elements each receive a portion of the first end of a bar of one of the first and second pairs of bars such that the brace and the first end of each of the bars inserted into the receiving elements are in substantially the same plane.

5. The portable chair frame of claim 2 further comprising:

a second brace; and a third pair of collapsible bars;

wherein the first pair of collapsible bars, that each include a joint that provides a point of contact with the surface, have a first end coupled to the first brace and a second end coupled to the second brace; and wherein the third pair of collapsible bars each have a first end coupled to the second brace and a second end that provides a sling interface.

6. The portable chair frame of claim 1, wherein the bar sections of the first and second pairs of bars include a first bar section with an end portion with an outer diameter dimension and a second bar section with an end portion that defines a recess and is adapted to receive the outer diameter dimension of the end portion of the first bar section.

7. The portable chair frame of claim 1, further comprising a cord, wherein the bar sections of at least one of the first and second bars are hollow and are coupled together by the cord.

8. The portable chair frame of claim 7, further comprising a brace that is coupled to the first end of each of the first pair of bars and the first end of each of the second pair of bars, wherein the cord runs through bar sections of at least one of the first bars, through the brace, and through bar sections of at least one of the second bars.

9. The portable chair frame of claim 8, further comprising a bag having a length less than 10 inches and a diameter less than 5 inches, wherein the brace and each of the first and second pairs of bars are collapsible and storable within the bag.

10. The portable chair frame of claim 1, further comprising a base, coupled to at least one joint, that cooperates with the at least one joint to provide a ground surface point of contact with an increased surface area.

11. A portable chair, including a front and a back, that support a user with the legs of the user toward the front of the portable chair and the back of the user toward the back of the portable chair, the portable chair comprising:

a sling that supports the user;

a chair frame that supports the sling, the chair frame comprising:

a first pair of bars that are each collapsible and include a plurality of bar sections, each of the first pair of bars having a first end and a second end;

a second pair of bars that are each collapsible and include a plurality of bar sections, each of the second pair of bars having a first end arranged substantially toward the back of the chair and a second end arranged substantially toward the front of the chair;

wherein the first end of each bar of the first pair of bars is coupled to a first end of a bar of the second pair of bars;

wherein each bar of the first pair of bars includes a joint that provides a point of contact with a ground surface and couples a first bar section to at least a second bar section at a substantially right angle to the first bar section; and wherein each of the second ends of each bar of the first and second pairs of bars provides a sling interface to cooperatively arrange the sling such that the weight of the user is substantially located in front of the joints of the first pair of bars; and wherein the sling includes a seat bottom portion with two frame interface elements and a seat back portion with two frame interface elements, wherein the four frame interface elements are coupleable to the four sling interfaces of the first and second pairs of bars of the chair frame.

12. The portable chair frame of claim 11 wherein the seat bottom frame interface elements couple to the first pair of bars and the seat back frame interface elements couple to a second pair of bars such that the brace is substantially adjacent to the seat back portion of the sling.

13. The portable chair of claim 11, wherein the sling includes an adjustment element that couples the seat bottom portion to the seat back portion, wherein the length of the adjustment element may be lengthened or shortened.

14. The portable chair of claim 11, wherein the sling includes a shaping element that provides a bucket shape to the sling and that allows the sling to contain the hips of a user.

15. The portable chair of claim 14, wherein the shaping element is a gusset that runs from the seat bottom portion to the seat back portion.

16. The portable chair of claim 15, wherein the seat back portion of the sling includes a panel that couples the two frame interface elements to one another.

17. The portable chair of claim 11, further comprising a brace that is coupled to the first ends of each of the first pair of bars and the first ends of each of the second pair of bars.

18. The portable chair of claim 17, wherein the seat back frame interface elements couple to the first pair of bars and the seat bottom frame interface elements couple to the second pair of bars such that the brace is substantially adjacent to the seat bottom portion of the sling.

19. The portable chair of claim 17, further comprising a bag having a length less than 10 inches and a diameter less than 5 inches, wherein the sling, the brace, and the collapsible bars are storable within the bag.

20. A portable chair, operable between an assembled state and a collapsed state, the portable chair comprising:

a frame, including:

two upper contact points defined by the first ends of two upper poles, each upper pole comprising a plurality of collapsible hollow bars;

two lower contact points defined by the first ends of two lower poles, each lower pole comprising a plurality of collapsible hollow bars;

two ground contact points defined by two joints, each joint configured to receive a second end of an upper pole and a second end of a lower pole;

a junction configured to removably engage two hollow bars of each of the two lower poles, the two lower poles intersecting at the junction in the assembled state; and an elastic cord passing through a plurality of the hollow bars and one of the joints, the elastic cord configured to retain the plurality of the hollow bars and the joint in the assembled state until separated into the collapsed state; and a sling, including:

a seat back portion;

a seat bottom portion;

two upper frame interfaces, each configured to removably engage an upper contact point of the frame; and two lower frame interfaces, each configured to removably engage a lower contact point of the frame;

wherein, in the assembled state, the sling is suspended across the upper contact points and the lower contact points.

21. The portable chair of claim 20, wherein the elastic cord further passes through the junction.

22. The portable chair of claim 21, further comprising a second elastic cord, wherein the elastic cord passes through one upper pole, one joint, the junction, and one lower pole, and wherein the second elastic cord passes through the other upper pole, the other joint, the junction, and the other lower pole.

23. The portable chair of claim 20, further comprising a junction configured to removably engage two bars of each of the two upper poles in the assembled state.

24. The portable chair of claim 20, wherein the hollow bars, of the upper and lower poles, comprise an aluminum alloy.

25. The portable chair of claim 20, wherein the seat back and seat bottom portions of the sling are of a fabric material.

26. The portable chair of claim 20, wherein at least one of the upper and lower poles comprises a first hollow bar and a second hollow bar, wherein the first hollow bar includes a first section of a first outer diameter and a second section of a second outer diameter less than the first diameter, and wherein the second section of the first bar is configured to slide into a recess on one end of the second hollow bar, wherein the recess on the one end of the second hollow bar has an inner diameter slightly larger than the outer diameter of the second section of the first hollow bar.

27. The portable chair of claim 20, further comprising a bag having a length less than 10 inches and a diameter less than 5 inches, the bag configured to hold the sling and the frame in the collapsed state.

28. The portable chair of claim 20, wherein, in the assembled state, each joint receives the second end of an upper pole perpendicular to the second end of a lower pole.

29. A portable chair, operable between an assembled state and a collapsed state, the portable chair comprising:

a frame, including:

two upper contact points defined by the first ends of two upper poles, each upper pole comprising a plurality of collapsible hollow bars;

two lower contact points defined by the first ends of two lower poles, each lower pole comprising a plurality of collapsible hollow bars;

two ground contact points defined by two joints, each joint configured to receive a second end of an upper pole perpendicular to a second end of a lower pole in the assembled state; and an elastic cord passing through a plurality of the hollow bars and one of the joints, the elastic cord configured to retain the plurality of the hollow bars and the joint in the assembled state until separated into the collapsed state; and a sling, including:

a seat back portion;

a seat bottom portion;

two upper frame interfaces, each configured to removably engage an upper contact point of the frame; and two lower frame interfaces, each configured to removably engage a lower contact point of the frame;

wherein, in the assembled state, the sling is suspended across the upper contact points and the lower contact points.

30. The portable chair of claim 29, further comprising a junction configured to removably engage two hollow bars of each of the two lower poles in the assembled state.

31. The portable chair of claim 30, wherein the two lower poles intersect at the junction.

32. The portable chair of claim 30, wherein the elastic cord further passes through the junction.

33. The portable chair of claim 32, further comprising a second elastic cord, wherein the elastic cord passes through one upper pole, one joint, the junction, and one lower pole, and wherein the second elastic cord passes through the other upper pole, the other joint, the junction, and the other lower pole.

34. The portable chair of claim 29, further comprising a junction configured to removably engage two bars of each of the two upper poles in the assembled state.

35. The portable chair of claim 29, wherein the hollow bars, of the upper and lower poles, comprise an aluminum alloy.

36. The portable chair of claim 29, wherein the seat back and seat bottom portions of the sling are of a fabric material.

37. The portable chair of claim 29, wherein at least one of the upper and lower poles comprises a first hollow bar and a second hollow bar, wherein the first hollow bar includes a first section of a first outer diameter and a second section of a second outer diameter less than the first diameter, and wherein the second section of the first bar is configured to slide into a recess on one end of the second hollow bar, wherein the recess on the one end of the second hollow bar has an inner diameter slightly larger than the outer diameter of the second section of the first hollow bar.

38. The portable chair of claim 29, further comprising a bag having a length less than 10 inches and a diameter less than 5 inches, the bag configured to hold the sling and the frame in the collapsed state.

* * * * *